US008122534B2

(12) United States Patent
Biersteker et al.

(10) Patent No.: US 8,122,534 B2
(45) Date of Patent: Feb. 28, 2012

(54) MULTI-POSITION SUPPORT FOR A FOLDING PATIENT LIFT DEVICE

(75) Inventors: Melvin C. Biersteker, Los Angeles, CA (US); Colin C. Bain, Stevens Point, WI (US); David J. Genske, Plover, WI (US); Erik J. Bluemner, Stevens Point, WI (US)

(73) Assignee: Joerns Healthcare, LLC, Stevens Point, WI (US)

( * ) Notice: Subject to any disclaimer, the term of this patent is extended or adjusted under 35 U.S.C. 154(b) by 100 days.

(21) Appl. No.: 12/705,931

(22) Filed: Feb. 15, 2010

(65) Prior Publication Data

US 2010/0162483 A1 Jul. 1, 2010

Related U.S. Application Data

(62) Division of application No. 12/335,104, filed on Dec. 15, 2008, now Pat. No. 7,921,486.

(60) Provisional application No. 61/009,236, filed on Dec. 27, 2007.

(51) Int. Cl.
*A61G 7/10* (2006.01)

(52) U.S. Cl. ..... 5/86.1; 5/87.1; 5/81.1 R; 5/83.1

(58) Field of Classification Search ..... 5/86.1, 5/81.1 R, 83.1, 87.1
See application file for complete search history.

(56) References Cited

U.S. PATENT DOCUMENTS

| | | | | |
|---|---|---|---|---|
| 4,682,377 | A * | 7/1987 | Reich | 5/83.1 |
| 5,502,851 | A | 4/1996 | Costello | |
| 2005/0034231 | A1 * | 2/2005 | Huang | 5/86.1 |

FOREIGN PATENT DOCUMENTS

WO 95/18592 7/1995

OTHER PUBLICATIONS

European Patent Office, Partial Search Report dated Mar. 24, 2010, from related European application.
European Patent Office, Search Report dated Jun. 10, 2006, from related European application.

* cited by examiner

*Primary Examiner* — Robert G Santos
*Assistant Examiner* — Brittany Wilson
(74) *Attorney, Agent, or Firm* — MacMillan, Sobanski & Todd, LLC

(57) ABSTRACT

A stand assist device includes a base with legs that extend in a forward direction. The stand assist device also includes a mast assembly mounted on the base, the mast assembly including a mast. A boom is pivotally attached to the mast and an actuator is attached to the boom. The actuator is adapted to be driven in order to cause the boom to rotate relative to the mast. A knee pad is also attached relative to the mast assembly. The mast may be moved between a seated position wherein the mast extends upwardly from the base, and a folded position wherein the mast extends substantially in the forward direction. The base, mast assembly, and knee pad are configured so that the knee pad does not interfere with the base when the mast is moved into the folded position.

20 Claims, 6 Drawing Sheets

MULTI-POSITION SUPPORT FOR A FOLDING PATIENT LIFT DEVICE

RELATED APPLICATIONS

This application is a divisional patent application of currently U.S. patent application Ser. No. 12/335,104, filed Dec. 15, 2008 now U.S. Pat. No. 7,921,486, and entitled "Multi-Position Support for Patient Support Device," the disclosure of which is incorporated herein by reference. U.S. patent application Ser. No. 12/335,104 claims priority from U.S. Provisional Patent Application Ser. No. 61/009,236, filed Dec. 27, 2007, and entitled MULTI-POSITION SUPPORT FOR PATIENT SUPPORT DEVICE.

BACKGROUND OF THE INVENTION

This invention relates in general to patient lifting and transferring. In particular, the invention relates to a device for lifting a disabled person from a sitting to a standing position and permitting the person to be readily moved.

It is often desirable to assist a disabled person in standing. This is particularly useful when the disabled person lacks strength or coordination to lift himself or herself. To assist these patients, it is common to have a patient lift, which can function as a lift or a stand assist device. An attendant may be required to assist the patient in using the device.

A lift typically includes a sling for supporting a patient. The sling may be lifted by a movable arm. In a lift, the patient is typically completely supported from an overhead position and has no active role in supporting him or herself or assisting in being lifted. A lift is commonly used to temporarily raise a patient or transport the patient without discomfort.

A stand assist device is used to lift a patient from a sitting position to a generally standing position. The device may include an upright member and an arm or support member movable by an actuator. When supported by the device, the patient may stand at an angle on a foot plate and hold the support member. With the support member lowered to a comfortable level to be used as a handle and with the foot plate removed, the device may be used to assist the patient in walking.

A sling may be used with a stand assist device to assist in supporting the patient. The sling may pass behind the patient's back and under the patient's arms and be suspended from the support member. With the sling in place, the patient can be lifted to a generally erect position.

A stand assist device may also be used with a sling to lift and suspend a patient. Once the patient is suspended, the stand may be moved to transport the patient or the patient may remain supported during patient care, such as while changing the patient's clothes or permitting the patient to use a toilet.

SUMMARY OF THE INVENTION

This invention relates to a stand assist device comprising a base with legs that extend in a forward direction. The stand assist device also includes a mast assembly mounted on the base, the mast assembly including a mast. A boom is pivotally attached to the mast and an actuator is attached to the boom. The actuator is adapted to be driven in order to cause the boom to rotate relative to the mast. A knee pad is also attached relative to the mast assembly. The mast may be moved between a seated position wherein the mast extends upwardly from the base, and a folded position wherein the mast extends substantially in the forward direction. The base, mast assembly, and knee pad are configured so that the knee pad does not interfere with the base when the mast is moved into the folded position.

This invention also relates to a stand assist device comprising a base with legs that extend in a forward direction. The stand assist device also includes a foot plate attached to the base. The foot plate has a step area and is configured to support the feet of a patient using the patient lift. The stand assist device also includes a mast assembly mounted on the base. The mast assembly includes a mast. A boom is pivotally attached to the mast assembly and a knee pad is also attached to the mast assembly. The knee pad may be moved relative to the mast to a variety of positions including a storage position. The mast may be moved between a seated position wherein the mast extends upwardly from the base, and a folded position wherein the mast extends substantially in the forward direction. The base, mast assembly, and knee pad are configured so that the knee pad does not interfere with the base when the mast is moved into the folded position when the knee pad is in the storage position.

This invention also relates to a stand assist device including a base. The base includes at least two legs that extend in a forward direction and a leg space is defined between two of the legs. The stand assist device includes a foot plate attached to the base. The foot plate has a step area and is configured to support the feet of a patient using the patient lift. A mast assembly is mounted on the base and the mast assembly includes a mast. A boom is pivotally attached to the mast assembly. An actuator is attached to the boom and is adapted to be driven in order to cause the boom to rotate relative to the mast assembly. A knee pad is also attached to the mast assembly. The mast may be moved between a seated position wherein the mast extends upwardly from the base, and a folded position wherein the mast extends substantially in the forward direction. The base, mast assembly, and knee pad are configured so that the knee pad does not interfere with the base when the mast is moved into the folded position and at least a portion of the knee pad is located in the leg space when the mast is moved into the folded position.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
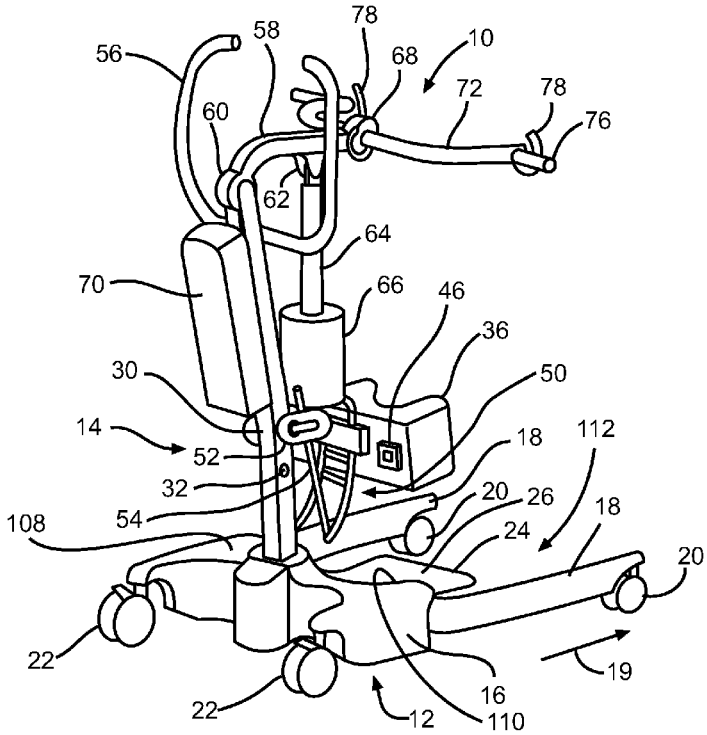
FIG. 1 is a perspective view, taken from behind, of a patient stand assist device.

Referring now to the drawings, there is illustrated in FIG. 1 one embodiment of a patient lift 10. It should be appreciated that the illustrated patient lift 10 is a patient stand assist device. The illustrated patient lift 10 includes a base assembly, indicated generally at 12 and a mast assembly, indicated generally at 14.

Figure 12:
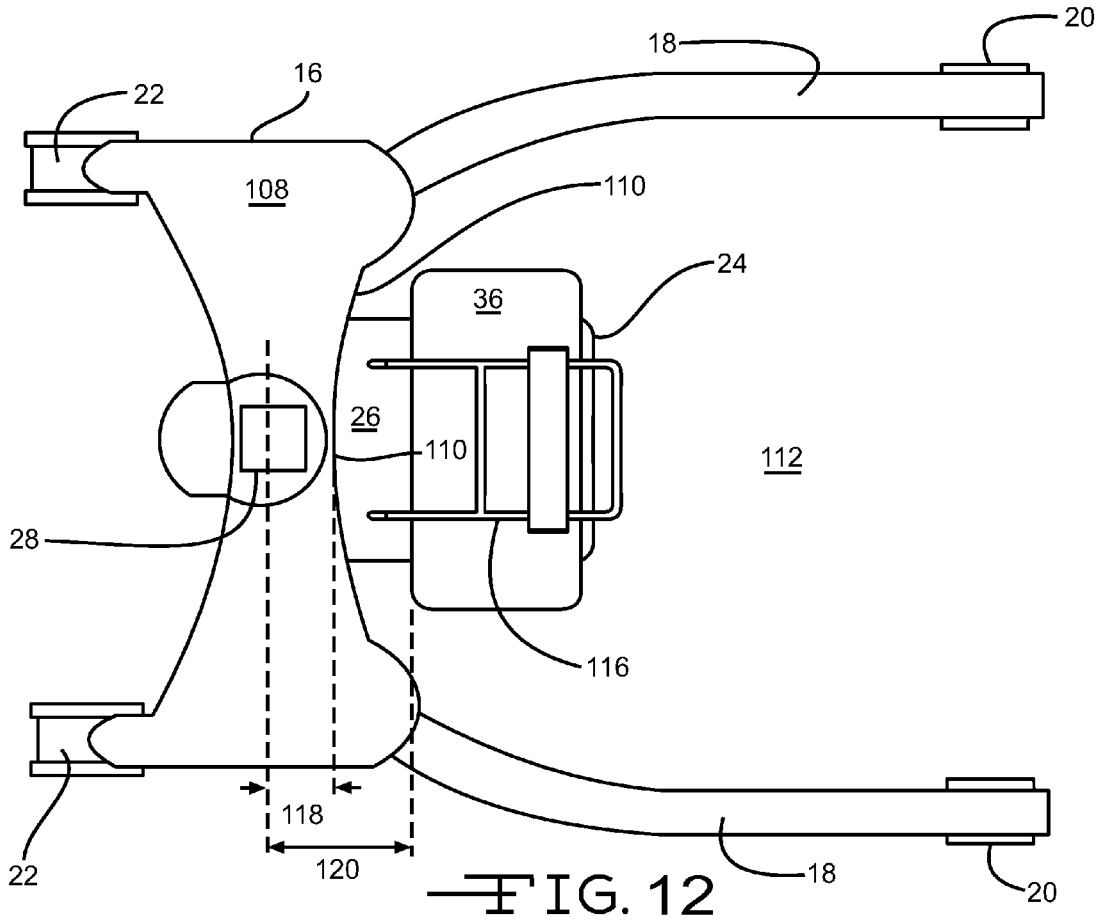
FIG. 12 is a cross-sectional view taken through the line 12-12 in FIG. 9.

The illustrated base assembly 12 includes a base 16. As shown in FIGS. 1 and 12, the base 16 includes a raised portion 108. The raised portion 108 ends at a base edge 110 at the side of the raised portion 108 facing in a forward direction 19. The base assembly 12 also includes a pair of legs 18. The legs 18 extend in the forward direction 19. The legs 18 are spaced apart so that there is a gap or space between the legs, such as the leg space, indicated generally at 112. It should be appreciated that in the illustrated patient stand assist device 10, the base edge 110 is located on the rearward side of the leg space 112. The illustrated legs 18 are mounted for pivotal movement relative to the base 16. The illustrated legs 18 are configured to rotate about separate hinges having substantially vertical axes. This allows an operator to spread the legs 18 apart or move the legs 18 closer together. It should be appreciated that changing the spacing of the legs 18 will change the size and shape of the leg space 112. The legs 18 can be configured to be moved by foot pedals (not shown) or any other suitable means.

The illustrated base assembly 12 includes two front casters 20 and two rear casters 22. The illustrated rear casters 22 are braked casters, but it should be appreciated that this is not required. The casters 20 and 22 are configured to support and allow rolling movement of the patient lift 10.

The base assembly 12 also includes an optional foot plate 24. The illustrated foot plate 24 is located within the leg space 112, although it should be appreciated that the foot plate 24 could be located outside the leg space 112. The foot plate 24 includes a step area 26. The step area 26 is configured to support the feet of a patient using the patient lift 10. The illustrated foot plate 24 is configured to be removable from the patient lift 10. This allows the foot plate 24 to be moved so that the patient lift 10 can be used, as a walking device, for instance, without the patient's using the foot plate 24 or the step area 26. The foot plate 24 could also be mounted for pivotal movement relative to the base 16.

Figure 4:
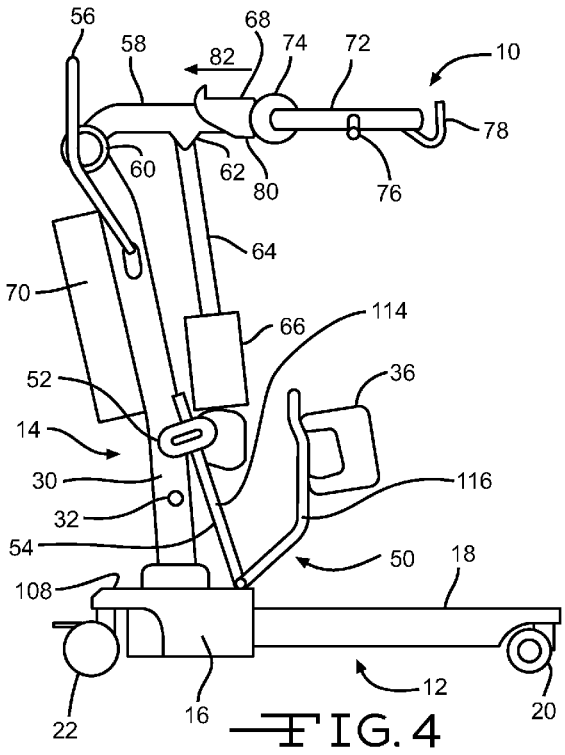
FIG. 4 is side view of the patient stand assist device of FIG. 1, showing the knee pad in a low position and the support member in a first position.
Figure 5:
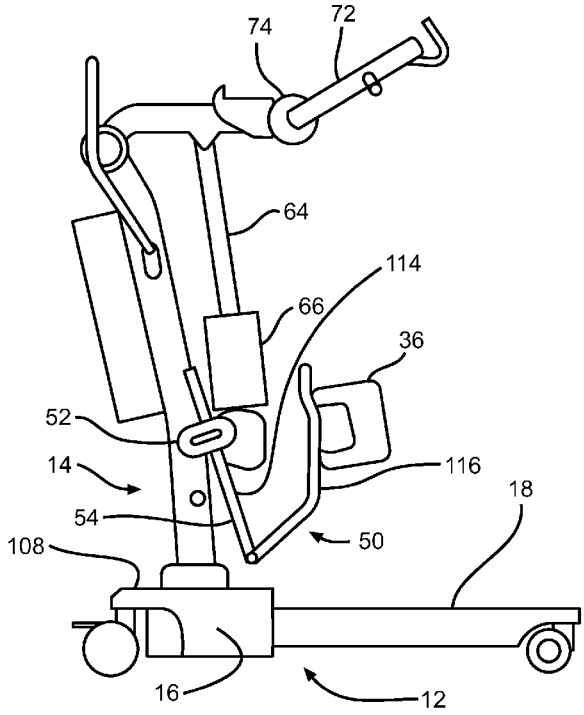
FIG. 5 is a side view of the patient stand assist device of FIG. 1, showing the knee pad in an intermediate position and the support member in a second position.
Figure 6:
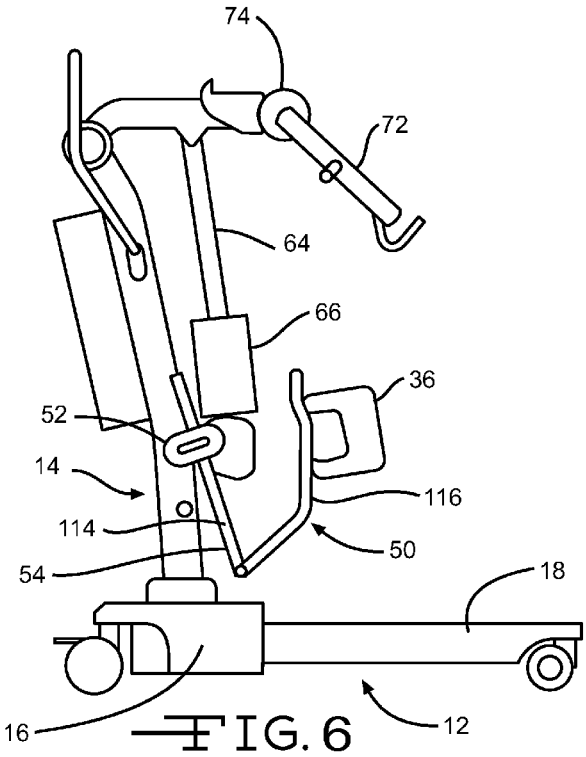
FIG. 6 is a side view of the patient stand assist device of FIG. 1, showing the knee pad in an intermediate position and the support member in a third position.
Figure 7:
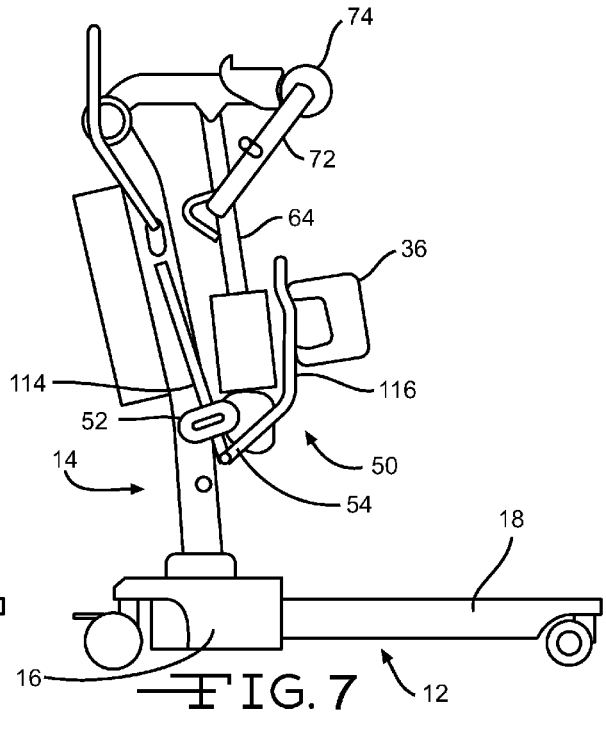
FIG. 7 is a side view of the patient stand assist device of FIG. 1, showing the knee pad in a raised position and the support member in a fourth position.
Figure 8:
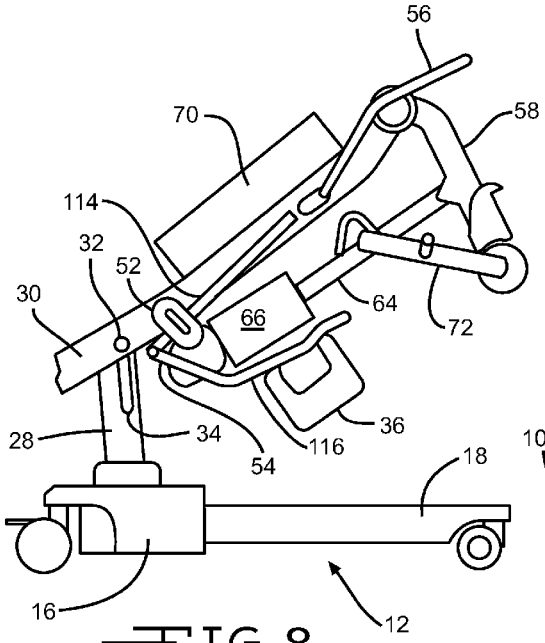
FIG. 8 is a side view of the patient stand assist device of FIG. 1, showing the mast raised and pivoted toward a folded position.
Figure 9:
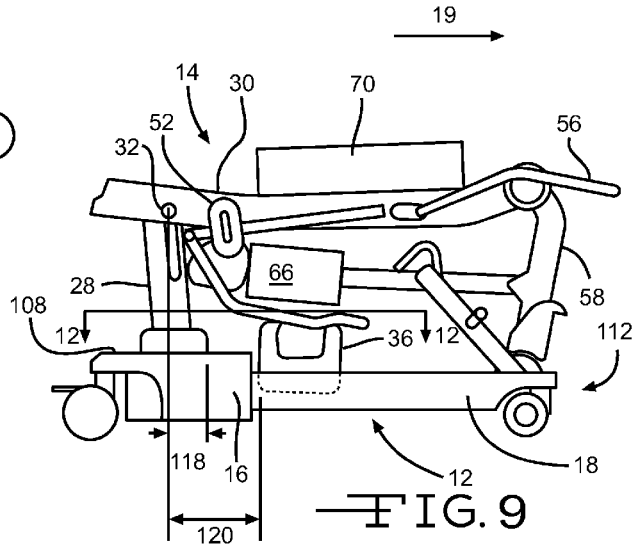
FIG. 9 is a side view of the patient stand assist device of FIG. 1, in the folded position.

In the illustrated patient lift 10, the mast assembly 14 is attached to the base 16. As can be best seen in FIG. 8, the mast assembly 14 includes a column 28 that is mounted on the base 16. The illustrated column 28 is disposed with a substantially vertical orientation. It should be appreciated that the column 28 could have a different orientation than that illustrated. A mast 30 is mounted on the column 28. As shown in FIG. 4, the mast 30 may be positioned in a seated position. In the seated position, the mast 30 extends upwardly from the base 16. The mast 30 is a substantially hollow piece, and the inner diameter of the mast 30 is large enough to accommodate the outer diameter of the column 28. A mast hinge or sliding hinge 32 attaches the mast 30 to the column 28. The sliding hinge 32 has a substantially horizontal axis, and allows the mast 30 to pivot relative to the column 28 for folding. The sliding hinge 32 is also able to move in a substantially vertical channel 34 defined in the column 28 to raise the mast 30 relative to the column 28 prior to folding. The mast 30 is shown in its seated position in FIG. 1. The mast 30 can be moved upwards to a raised position, with the sliding hinge 32 moving in the channel 34. The mast 30 can then be pivoted about the sliding hinge 32, into a folded position. As shown in FIG. 9, in the folded position the mast 30 extends substantially in the forward direction 19. When the mast 30 is moved into the folded position, the patient lift 10 takes up less space, and is easier to transport and store. The mast 30 is illustrated in its folded position in FIG. 9, and is shown in an intermediate position in FIG. 8.

Figure 10:
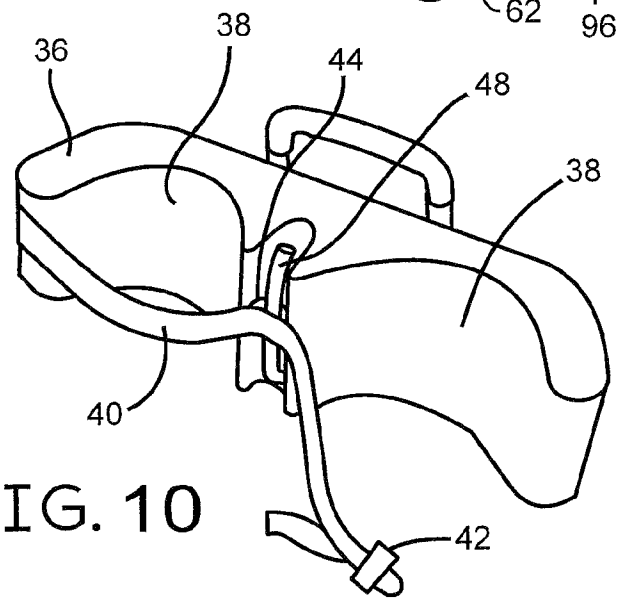
FIG. 10 is a perspective view of the knee pad of the patient stand assist device of FIG. 1, including a strap attached to the knee pad.

The patient lift 10 includes a knee pad 36. The knee pad 36 provides support for the patient using the patient lift 10. The illustrated knee pad 36 includes optional resilient padding as a cushion for the patient's comfort. As is best shown in FIG. 10, the illustrated knee pad 36 includes two recesses 38. Each recess 38 is a support surface configured to accommodate one leg of the patient using the patient lift 10. The recesses 38 are configured to provide secure and comfortable engagement between the patient and the patient lift 10. The knee pad 36 also includes an optional strap 40. The strap 40 allows the patient's legs to be held in position when using the patient lift 10. The illustrated strap 40 includes a buckle tongue 42 on each end (only one is visible in FIG. 10), and a central loop 44 in the middle. As can be best seen in FIG. 1, the knee pad 36 includes two buckles 46 on the side of the knee pad 36 opposite from the recesses 38. It should be appreciated that only one buckle 46 is shown in FIG. 1. The second buckle 46 is not visible in FIG. 1 because it is behind the mast 30 in this perspective view. The buckles 46 are configured to engage the buckle tongues 42 on the strap 40. The illustrated knee pad 36 also includes a horn 48 located between the two recesses 38. The horn 48 and the central loop 44 are configured so that the central loop 44 can be secured to the horn 48. The illustrated central loop 44 is secured to the horn 48 by sliding the central loop 44 over the upper end of the horn 48.

The combination of the buckles 46 and the horn 48 allow the strap 40 to be used to secure the patient's legs to the knee pad 36 in a number of positions based on the individual patient requirements. For instance, when each buckle tongue 42 is attached to a buckle 46 and the central loop 44 is attached to the horn 48, the most secure engagement with the patient is provided as each of the patient's legs is individually secured. When each buckle tongue 42 is attached to a buckle 46 but the central loop 44 is not attached to the horn 48, the patient is held in engagement with the knee pad 36, but the patient can be released by releasing either buckle 46. This provides greater convenience to an attendant using the patient lift 10. The central loop 44 is attached to the horn 48 and only one of the buckle tongues 42 is attached to a buckle 46 when only one leg is secured to the knee pad 36. This is useful when the patient is missing the lower part of one leg. The central loop 44 is attached to the horn 48 and neither buckle tongue 42 is attached to the buckles 46 for storage of the strap 40. The strap 40 does not secure the patient to the knee pad 36 when the strap 40 is stored like this, but the strap 40 remains secured to the patient lift 10 and is less likely to be misplaced.

A knee pad mounting assembly, indicated generally at 50, attaches the illustrated knee pad 36 to the mast 30. The illustrated knee pad mounting assembly 50 is adjustable to allow the position of the knee pad 36 to be changed for the convenience and comfort of the patient. The knee pad mounting assembly 50 includes a mounting bracket 52. The mounting bracket 52 is attached to a fixed position on the mast 30. The mounting bracket 52 releasably grips a guide tube 54 of the knee pad mounting assembly 50. As best seen in FIG. 4, the guide tube 54 includes an engagement branch 114 and a mounting branch 116. As shown in FIGS. 4 through 7, the height of the knee pad 36 can be adjusted by releasing the mounting bracket 52, sliding the guide tube 54 up or down relative to the mounting bracket 52, then re-engaging the mounting bracket 52 in order to grip the engagement branch 114 of the guide tube 54. The knee pad 36 is mounted on the mounting branch 116 of the guide tube 54. In the illustrated embodiment, the mounting branch 116 is non-collinear with the engagement branch 114 of the guide tube 54. The knee pad 36 is shown in a low position in FIG. 4 while it is shown in its most raised position in FIG. 7. The knee pad 36 and knee pad mounting assembly 50 are configured to allow the knee pad 36 to be positioned in a variety of positions throughout an operating range. The operating range is a range of positions in which the knee pad 36 is positioned to act as a fulcrum for the patient's knees or legs, and the operating range is selected to accommodate the physiology of anticipated patients. As can be best seen in reference to FIG. 9, the knee pad mounting assembly 50 is configured so that when the knee pad 36 is moved into its most raised position before folding, the knee pad 36 is high enough that it will not interfere with the base assembly 12, particularly the base 16, when the mast 30 is moved into the folded position. That is, as seen in FIG. 9, the knee pad 36 is far enough to the right that it does not interfere with the base 16 or the foot plate 24 when the mast 30 is moved to the folded position. This allows the patient lift 10 to be put into its folded position for storage or transportation without having to remove the foot plate 24, the knee pad 36, or other components. It should be understood that the illustrated knee pad 36 is between the legs 18 when the mast 30 is in the folded position. That is, when the knee pad 36 is in the storage position and the mast 30 is moved to the folded position, a portion of the knee pad 36 is located in the leg space 112. It should be appreciated that the knee pad is situated farther from the mast hinge 32 in the forward direction 19 than the base edge 110 is. That is, as best seen in reference to FIG. 12, the base edge 110 is a first distance 118 from the mast hinge 32 in the forward direction 19. The knee pad is a second distance 120 from the mast hinge 32 in the forward direction 19 when the knee pad 36 is in the storage position and the mast 30 is in the folded position. The second distance 120 is greater than the first distance 118. The described configuration of the knee pad mounting assembly 50 makes it easier for an operator or attendant to fold and unfold the patient lift 10. Since there are no parts to be removed or replaced from the patient lift 10, there are fewer steps involved in folding or unfolding the patient lift 10. Also, this makes it less likely for components of the patient lift 10 to be lost. Since no parts need to be removed when the patient lift 10 is folded, there are no separately stored parts to misplace.

The illustrated knee pad mounting assembly 50 is configured to provide substantially linear movement of the knee pad 36 through the operating range and to the most raised position. As illustrated in FIGS. 4 through 7, this is accomplished by the substantially linear engagement branch 114 of the guide tube 54 being moved relative to the mounting bracket 52. It should be appreciated that this is not necessary, and the knee pad 36 could be configured for some other type of movement. Additionally, the most raised position of the illustrated knee pad 36 is outside the operating range. It should be appreciated that this is not necessary. Movement of the knee pad 36 could be limited to the operating range, for instance.

The illustrated patient lift 10 includes an optional steering handle 56. The illustrated steering handle 56 is mounted on the mast 30. The steering handle 56 is provided to assist the attendant in moving and maneuvering the patient lift 10.

The patient lift 10 includes a boom 58. An inner end of the boom 58 is pivotally attached to the upper end of the mast 30 by a boom hinge 60. The illustrated boom hinge 60 has a substantially horizontal axis. The boom 58 also includes an actuator pivot 62. The illustrated actuator pivot 62 is attached to the upper end of an arm or actuator 64. The actuator 64 may be an electronic ball screw actuator or other suitable actuator. The illustrated actuator 64 is attached to a motor 66. The illustrated motor 66 is also mounted to the mast 30. The motor 66 is configured to extend or retract the actuator 64. By driving the actuator 64, the motor is able to cause the boom 58 to pivot about the boom hinge 60. Pivoting the boom 58 about the boom hinge 60 will either raise or lower an outer end 68 of the boom 58. The illustrated motor 66 is an electric motor, and is powered by a power supply 70. The illustrated power supply 70 is attached to the mast 30. It should be appreciated that any other suitable mechanism may be used to move the boom 58.

Figure 2:
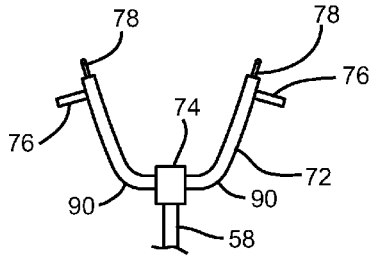
FIG. 2 is a plan view of the support member and a portion of the boom of the patient stand assist device of FIG. 1.
Figure 3:
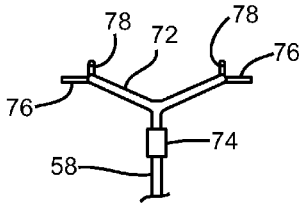
FIG. 3 is an plan view of an alternative, Y-shaped design of a support member suitable for the patient stand assist.

The outer end 68 of the boom 58 supports a pivotally attached support member 72. As best seen in FIG. 2, the illustrated support member 72 is a substantially U-shaped component. The support member 72 is attached to the boom 58 by a locking mechanism 74. The support member 72 includes a pair of optional hand-holds 76. The support member 72 also includes a pair of sling hooks or attachment points 78. One attachment point 78 is located at each end of the support member 72. The attachment points 78 on support member 72 are used to suspend a sling (not shown) used to lift the patient. It should be appreciated that FIG. 2 depicts only one possible configuration of the support member 72. The illustrated support member 72 includes two curved arms 90. Each arm 90 extends from an opposite side of the locking mechanism 74. An alternative configuration of support member 72 is illustrated in FIG. 3. The alternative configuration comprises a single element extending from the locking mechanism 74. The single element branches into two individual arms at a distance separated from the locking mechanism 74.

The locking mechanism 74 releasably grips the support member 72. When the locking member 74 is released, the support member 72 is able to rotate around a substantially horizontal axis. When the locking member 74 is engaged, the support member 72 is fixed relative to the boom 58. The illustrated locking mechanism 74 includes a release handle 80. The release handle 80 is configured to be moved by the attendant in a first direction, as indicated by the arrow 82. In the illustrated embodiment, the first direction 82 is the rearward direction. When the release handle 80 is moved in the first direction, the support member 72 is released for rotation relative to the boom 58. The release handle 80 is spring biased in a second direction, toward the support member 72. In the illustrated embodiment, the second direction is the forward direction 19. When the release handle 80 is moved in the second direction, the support member 72 is no longer able to rotate relative to the boom 58 and the support member 72 is fixed in its current angular position. It should be appreciated that while the illustrated release handle 80 moves in the forward direction 19 in order to lock the support member 72, the locking mechanism 74 can be configured so that the release handle 80 moves in other directions.

Figure 11:
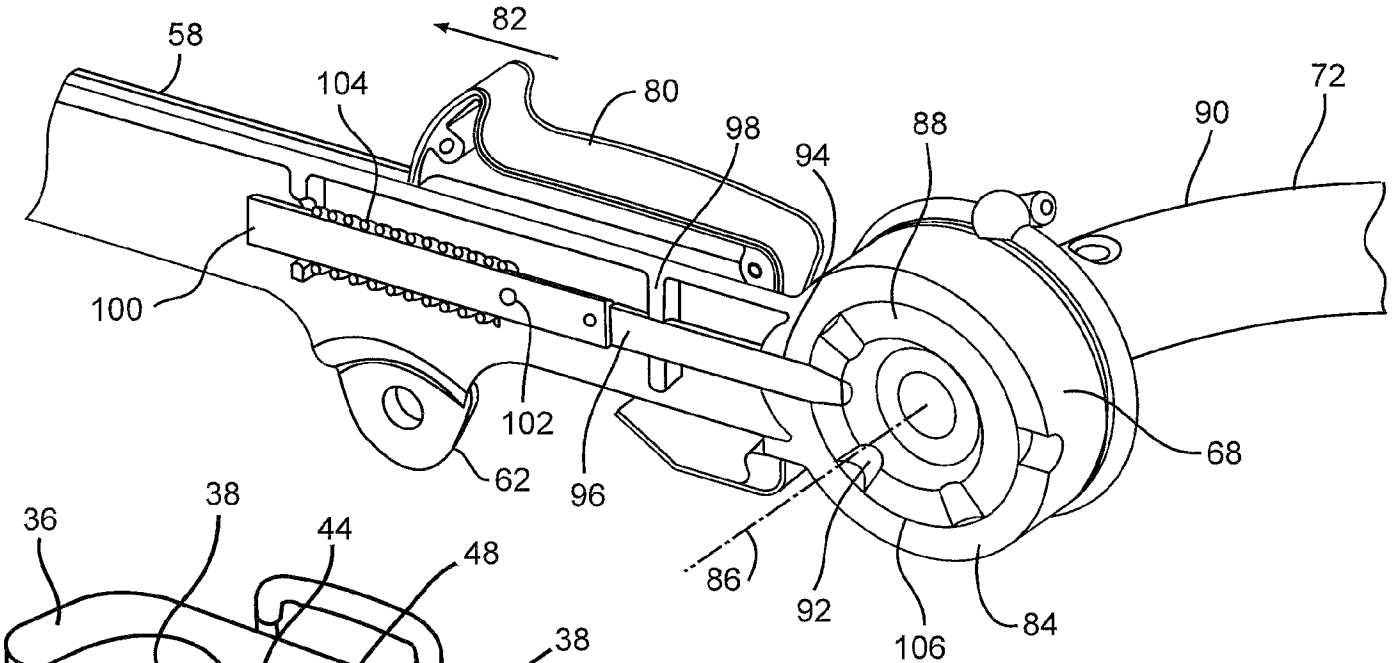
FIG. 11 is a perspective view, partially in cross-section, of the locking mechanism and a portion of the boom of the patient stand assist device of FIG. 1.

Referring to FIG. 11, a cross-section of the boom 58 and the locking mechanism 74 is shown. In the illustrated patient lift, the outer end 68 of the boom 58 includes an outer cylinder 84. The outer cylinder 84 is centered on a substantially horizontal centerline 86. An inner cylinder 88 is disposed inside the outer cylinder 84. The inner cylinder 88 is able to rotate about the centerline 86. As shown, support member 72 includes two arms 90 (one of which is visible in FIG. 11). The arms 90 are mounted on the inner cylinder 88, and are able to rotate about the centerline 86. The inner cylinder 88 defines a number of radial openings 92. The illustrated inner cylinder 88 includes four radial openings 92, situated with approximately 40 degrees separating adjacent openings. The outer cylinder 84 includes a radial bolt opening 94. In FIG. 11, a bolt 96 is disposed within the bolt opening 94. The bolt 96 is configured to pass through the bolt opening 94, one of the radial openings 92, and a bolt guide 98. As shown, the bolt 96 is attached to a plate 100. The plate 100 is attached to the release handle 80 by a pin 102. The locking mechanism 74 includes also includes a spring 104. The spring 104 is configured to provide a force biasing the plate 100 in the forward direction 19.

When the bolt 96 is disposed through the bolt opening 94 and one of the radial openings 92, the bolt 96 prevents rotation of the inner cylinder 88 about the centerline 86. Thus, the bolt 96 locks the position of the inner cylinder 88 relative to the outer cylinder 84 and the bolt 96 also locks the position of the support member 72 relative to the boom 58. Both the bolt 96 and the plate 100 are configured for sliding movement within the boom 58. The release handle 80 can be moved in the first direction (indicated by the arrow 82) by an attendant overcoming the biasing force of the spring 104. When the release handle is moved in the first direction 82, the plate 100 and the bolt 96 are also moved in the first direction 82. The locking mechanism is configured to move the bolt 96 a sufficient distance in the first direction to withdraw the bolt 96 from the radial opening 92. This allows the inner cylinder 88 to rotate about the centerline 86.

It should be appreciated that the weight of the support member 72 will tend to cause rotation of the inner cylinder 88 relative to the outer cylinder 84. In reference to FIG. 11, the support member will attempt to rotate the inner cylinder 88 in the clockwise direction. The inner cylinder 88 can be provided with rotational resistance relative to the outer cylinder 84 in order to resist the weight of the support member 72 and help prevent the inner cylinder 88 from freely rotating when the handle 80 is moved in the first direction 82. When the attendant decreases the force applied in the first direction 82 to the release handle 80, the spring 104 will bias the plate 100, the release handle 80 and the pin 96, rearward, toward the right as viewed in FIG. 11. It should be appreciated that if the inner cylinder 88 has been pivoted relative to the outer cylinder 84, the bolt 96 may strike the surface 106 of the inner cylinder 88. In that case, the inner cylinder 88 will still be able to rotate. However, when the inner cylinder has rotated sufficiently to radially align one of the radial openings 92 with the bolt opening 94, the bolt 96 will be pushed into the radial opening 92 by the force of the spring 104.

It should be appreciated that one, non-limiting embodiment of a locking mechanism 74 has been described in detail. However, any suitable locking mechanism 74 can be used with the patient lift 10.

The ability to adjust the support member 72 to various angular positions permits the patient lift 10 to accommodate a greater variety of patients. That is, the shape of the patient lift 10 can be changed, and the attachment points 78 can be repositioned to meet the patient's needs. The support member 72 is shown in a variety of positions in FIGS. 4 through 7. This also allows more compact folding of the patient lift 10. As shown in FIG. 9, the support member 72 may be adjusted so that a portion of the boom 58 is in the leg space 112 when the mast 30 is in the folded position. This allows the patient lift 10 to be folded into a more compact state than would otherwise be possible, since the support member 72 does not engage a floor or other surface that supports the patient lift 10. The previously-described locking mechanism 74 is configured so that the support member 72 can be locked into specific, preselected angular positions relative to the boom 58. The locking mechanism 74 could be configured so that the support member 72 can be locked into any angular position relative to the boom 58, such as by the use of a set screw, wing nut or friction plates, for example. It should further be appreciated that the locking mechanism could be configured to use preselected angular positions that the attendant can select and set prior to using the patient lift 10 to lift the patient.

It should be appreciated that when a load is placed on the support member 72, such as when the patient lift 10 is being used to lift a patient, the force of that load will generate a moment that tends to rotate the inner cylinder 88 about the centerline 86. The bolt 96 will prevent rotation of the inner cylinder 88, and the bolt 96 will be pinched between the inner cylinder 88 and the outer cylinder 84. This will increase the amount of force necessary to move the release handle 80 in the first direction 82. That is, when there is a load on the support member 72, it is more difficult to release the locking mechanism 72 for rotational adjustment of the support member 72. However, the locking mechanism could be configured to prevent release of the locking mechanism 72 when a load above a set amount is placed on the support member 72.

When used as a stand assist, the patient lift 10 is positioned in front of a patient. The legs 18 may be adjusted in width to provide a stable base arrangement. The patient's feet may be situated on the foot plate 24. A sling (not shown) may be suspended from the attachment points 78. The sling is passed behind the patient's back and under the patient's arms. The motor 66 is driven to extend the actuator 64. As the actuator 64 is extended, it pivots the boom 58 about the boom hinge 60, and raises the outer end 68 of the boom 58. This also raises the support member 72, and the attached sling. The support member 72 can be raised until the patient is supported by the foot plate 24 and the support member 72 and the desired height is reached.

When used as a patient lift, the patient lift 10 may be positioned adjacent the patient and stabilized by adjustment in width of the legs 18. A sling (not shown) may be placed under the patient and suspended from the attachment points 78. The motor 66 then drives the actuator 64 to raise the support member 72 in order to lift the patient. The patient may be completely supported by the sling. That is, the patient's weight is supported entirely by the patient lift 10 through the sling. When used as a patient lift, the patient's feet are not supported by the foot plate 24, and the foot plate 24 can be removed from the patient lift 10.

The patient lift 10 may be used as a walking device for the patient. When used as a walking device, the support member 72 is generally lowered to make it comfortable for the patient to use the hand-holds 76 and the foot plate 24 is removed. This helps the patient to comfortably hold either the hand-holds 76 or the support member 72 while walking.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A stand assist device comprising:

a base including legs that extend in a forward direction;

a mast assembly mounted on the base, the mast assembly including a mast, the mast configured to be movable between a seated position wherein the mast extends upwardly from the base, and a folded position wherein the mast extends substantially in the forward direction;

a boom pivotally attached to the mast;

an actuator attached to the boom, the actuator adapted to be driven in order to cause the boom to rotate relative to the mast; and a knee pad attached relative to the mast assembly; wherein the knee pad may be moved relative to the mast to a variety of positions throughout an operating range to accommodate the physiology of anticipated patients and the knee pad may be moved to a storage position that is outside the operating range;

wherein the base, mast assembly, and knee pad are configured so that the knee pad does not interfere with the base when the mast is moved into the folded position when the knee pad is in the storage position.

2. The stand assist device of claim 1, further comprising:

a foot plate attached to the base, the foot plate having a step area configured to support the feet of a patient using the patient lift, wherein the knee pad does not interfere with the foot plate when the mast is moved into the folded position.

3. The stand assist device of claim 2, wherein the knee pad may be moved relative to the mast to a variety of positions including a storage position and wherein the knee pad does not interfere with the base when the mast is moved into the folded position and when the knee pad is in the storage position.

4. The stand assist device of claim 3, wherein the knee pad is attached relative to the mast assembly by a knee pad mounting assembly including a mounting bracket fixed relative to the mast assembly and a guide tube, the guide tube including an engagement branch that is releasably gripped by the mounting bracket and a mounting branch, wherein the knee pad is fixed relative to the mounting branch.

5. The stand assist device of claim 4, wherein the engagement branch of the guide tube is substantially linear and wherein the mounting branch is non-collinear with the engagement branch.

6. The stand assist device of claim 3, further comprising:

a leg space defined between the legs, wherein at least a portion of the knee pad is located in the leg space when the mast is moved into the folded position and when the knee pad is in the storage position.

7. The stand assist device of claim 6, wherein at least a portion of the boom is located in the leg space when the mast is moved into the folded position.

8. The stand assist device of claim 3, wherein:

the mast is configured to be moved between the seated position and the folded position by rotating about a mast hinge;

the base further includes a raised portion with a base edge, the base edge located a first distance from the mast hinge in the forward direction; and the knee pad is located a second distance from the mast hinge in the forward direction when the mast is moved into the folded position and when the knee pad is in the storage position, wherein the second distance is greater than the first distance.

9. A stand assist device comprising:

a base including legs that extend in a forward direction;

a mast assembly mounted on the base, the mast assembly including a mast, the mast configured to be movable between a seated position wherein the mast extends upwardly from the base, and a folded position wherein the mast extends substantially in the forward direction;

a boom pivotally attached to the mast;

an actuator attached to the boom, the actuator adapted to be driven in order to cause the boom to rotate relative to the mast;

a knee pad attached relative to the mast assembly; and wherein the base, mast assembly, and knee pad are configured so that the knee pad does not interfere with the base when the mast is moved into the folded position;

wherein the knee pad may be moved to a variety of positions throughout an operating range to accommodate the physiology of anticipated patients and the knee pad may be moved to a storage position that is outside the operating range and wherein the knee pad does not interfere with the base when the mast is moved into the folded position and when the knee pad is in the storage position.

10. The stand assist device of claim 9, wherein the knee pad is adapted for substantially linear movement through the operating range and to the storage position.

11. The stand assist device of claim 10, wherein the knee pad is attached relative to the mast.

12. The stand assist device of claim 11, wherein the knee pad is attached relative to the mast by a knee pad mounting assembly, the knee pad mounting assembly comprising a bracket and a guide tube, the guide tube being movable relative to the bracket when the bracket is released, and the guide tube being fixed relative to the bracket when the bracket is engaged.

13. A stand assist device comprising:

a base including legs that extend in a forward direction;

a foot plate attached to the base, the foot plate having a step area configured to support the feet of a patient using the patient lift;

a mast assembly mounted on the base, the mast assembly including a mast, the mast configured to be movable between a seated position wherein the mast extends upwardly from the base, and a folded position wherein the mast extends substantially in the forward direction;

a boom pivotally attached to the mast assembly; and a knee pad attached to the mast assembly, the knee pad configured to be movable relative to the mast to a variety of positions throughout an operating range to accommodate the physiology of anticipated patients and including a storage position that is outside the operating range;

wherein the base, mast assembly, and knee pad are configured so that the knee pad, when in the storage position, does not interfere with the base when the mast is moved into the folded position.

14. The stand assist device of claim 13, wherein the knee pad may be moved relative to the mast to a variety of positions including a storage position and including a variety of positions throughout an operating range to accommodate the physiology of anticipated patients, wherein the storage position is outside the operating range.

15. The stand assist device of claim 14, wherein the knee pad is adapted for substantially linear movement through the operating range and to the storage position.

16. The stand assist device of claim 15, wherein:

the mast is configured to be moved between the seated position and the folded position by rotating about a mast hinge;

the base further includes a raised portion with a base edge, the base edge located a first distance from the mast hinge in the forward direction; and the knee pad is located a second distance from the mast hinge in the forward direction when the mast is moved into the folded position when the knee pad is in the storage position, wherein the second distance is greater than the first distance.

17. A stand assist device comprising:

a base including at least two legs that extend in a forward direction, with a leg space defined between two of the legs, the base including casters configured to support and allow rolling movement of the base;

a foot plate attached to the base, the foot plate having a step area configured to support the feet of a patient using the patient lift;

a mast assembly mounted on the base, the mast assembly including a mast;

a boom pivotally attached to the mast assembly;

an actuator attached to the boom, the actuator adapted to be driven in order to cause the boom to rotate relative to the mast assembly; and a knee pad attached to the mast assembly wherein the knee pad may be moved relative to the mast to a variety of positions throughout an operating range to accommodate the physiology of anticipated patients and the knee pad may be moved to a storage position that is outside the operating range;

wherein the mast may be moved between a seated position wherein the mast extends upwardly from the base, and a folded position wherein the mast extends substantially in the forward direction;

wherein the base, mast assembly, and knee pad are configured so that the knee pad does not interfere with the base when the mast is moved into the folded position and at least a portion of the knee pad is located in the leg space when the mast is moved into the folded position when the knee pad is in the storage postion; and wherein the casters are configured to support and allow rolling movement of the base when the mast is moved to the folded position.

18. The stand assist device of claim 17, wherein:

the mast may be moved between the seated position and the folded position by rotating about a mast hinge;

the base further includes a raised portion with a base edge, the base edge located a first distance from the mast hinge in the forward direction; and the knee pad is located a second distance from the mast hinge in the forward direction when the mast is moved into the folded position, wherein the second distance is greater than the first distance.

19. The stand assist device of claim 18, wherein at least a portion of the boom is located in the leg space when the mast is moved into the folded position.

20. The stand assist device of claim 17, wherein at least a portion of the boom is located in the leg space when the mast is moved into the folded position.

* * * * *